US008079765B1

(12) United States Patent
Bledsoe et al.

(10) Patent No.: US 8,079,765 B1
(45) **Date of Patent: *Dec. 20, 2011**

(54) HAND-PROPELLED LABELING PRINTER

(75) Inventors: James D. Bledsoe, Corvallis, OR (US); James Mealy, Corvallis, OR (US); Asher Simmons, Corvallis, OR (US)

(73) Assignee: Marvell International Ltd. (BM)

( * ) Notice: Subject to any disclaimer, the term of this patent is extended or adjusted under 35 U.S.C. 154(b) by 868 days.

This patent is subject to a terminal disclaimer.

(21) Appl. No.: 12/074,018

(22) Filed: Feb. 28, 2008

Related U.S. Application Data

(60) Provisional application No. 60/892,727, filed on Mar. 2, 2007.

(51) Int. Cl.
*B41J 2/145* (2006.01)
*B41J 3/36* (2006.01)

(52) U.S. Cl. ..... 400/62; 400/88; 347/40; 347/109; 358/1.18; 358/1.5

(58) Field of Classification Search ..... 400/62
See application file for complete search history.

(56) References Cited

U.S. PATENT DOCUMENTS

| | | | | |
|---|---|---|---|---|
| 3,469,422 | A | 9/1969 | Minton | |
| 4,387,579 | A | 6/1983 | Branke et al. | |
| 4,714,936 | A * | 12/1987 | Helinski et al. | 347/38 |
| 5,351,069 | A | 9/1994 | Koike et al. | |
| 5,578,813 | A | 11/1996 | Allen et al. | |
| 5,593,236 | A * | 1/1997 | Bobry | 400/88 |
| 5,825,995 | A | 10/1998 | Wiklof et al. | |
| 5,861,877 | A * | 1/1999 | Kagayama et al. | 345/179 |
| 5,927,872 | A * | 7/1999 | Yamada | 400/88 |
| 6,000,946 | A | 12/1999 | Snyders et al. | |
| 6,030,582 | A | 2/2000 | Levy | |
| 6,217,017 | B1 | 4/2001 | Yamazaki | |
| 6,312,124 | B1 * | 11/2001 | Desormeaux | 347/109 |
| 6,332,677 | B1 | 12/2001 | Steinfeld et al. | |
| 6,357,939 | B1 | 3/2002 | Baron | |
| 6,390,249 | B2 | 5/2002 | Tachibana | |
| 6,467,870 | B2 * | 10/2002 | Matsumoto et al. | 347/19 |

(Continued)

FOREIGN PATENT DOCUMENTS

EP 1 543 981 A3 7/2006

(Continued)

OTHER PUBLICATIONS

GB Search Report for GB Application No. 0610837.7, dated Oct. 31, 2006, 2 pages.

(Continued)

*Primary Examiner* — Jill Culler

(57) ABSTRACT

A mobile, handheld and hand-propelled labeling printer is disclosed for use in printing label data on a storage object. The label data may include a description of the preservation item, the data and time that the preservation item was collected, the location from which it was collected, an identification of the person who collected the item, an identification number, and other data. The label data may be printed as text or code. The labeling printer receives image data of the label data. A user moves the labeling printer on a storage object for printing the label data while a position module provides absolute position data so that the label data is accurately printed. Complete consistency between stored label data and printed label is achieved because the image data is based on label data obtained from the stored label data.

22 Claims, 10 Drawing Sheets

U.S. PATENT DOCUMENTS

| | | | | |
|---|---|---|---|---|
| 6,517,266 | B2 * | 2/2003 | Saund | 400/88 |
| 6,580,244 | B2 | 6/2003 | Tanaka et al. | |
| 6,682,190 | B2 | 1/2004 | Rasmussen et al. | |
| 6,773,177 | B2 * | 8/2004 | Denoue et al. | 400/88 |
| 6,789,869 | B2 | 9/2004 | Takeishi | |
| 6,851,878 | B2 | 2/2005 | Hemmerlin | |
| 6,896,349 | B2 | 5/2005 | Valero et al. | |
| 6,933,889 | B1 | 8/2005 | Wolf et al. | |
| 6,942,335 | B2 | 9/2005 | Trent | |
| 6,951,778 | B2 | 10/2005 | Akhavain et al. | |
| 6,952,284 | B2 | 10/2005 | Andrews et al. | |
| 7,013,029 | B2 | 3/2006 | Keskar et al. | |
| 7,108,370 | B2 | 9/2006 | Breton | |
| 7,184,167 | B1 | 2/2007 | Ito et al. | |
| 7,336,388 | B2 | 2/2008 | Breton | |
| 7,627,189 | B2 | 12/2009 | Donomae et al. | |
| 7,679,604 | B2 | 3/2010 | Uhlik et al. | |
| 7,808,450 | B2 | 10/2010 | Wanda et al. | |
| 7,812,994 | B2 * | 10/2010 | Carlson et al. | 358/1.18 |
| 2003/0043388 | A1 | 3/2003 | Andrews et al. | |
| 2003/0152679 | A1 * | 8/2003 | Garwood | 426/392 |
| 2004/0252051 | A1 | 12/2004 | Johnson | |
| 2006/0050131 | A1 | 3/2006 | Breton | |
| 2006/0244347 | A1 | 11/2006 | Bae et al. | |
| 2006/0279784 | A1 | 12/2006 | Carlson et al. | |
| 2007/0009277 | A1 | 1/2007 | Shoen | |
| 2007/0080494 | A1 | 4/2007 | Marshall et al. | |
| 2007/0216737 | A1 | 9/2007 | Hart | |
| 2007/0263062 | A1 | 11/2007 | Noe et al. | |
| 2008/0075513 | A1 | 3/2008 | Robertson et al. | |
| 2008/0123126 | A1 | 5/2008 | Harris | |
| 2008/0144053 | A1 | 6/2008 | Gudan et al. | |
| 2008/0204770 | A1 | 8/2008 | Bledsoe et al. | |
| 2008/0211848 | A1 * | 9/2008 | Mealy et al. | 347/14 |
| 2008/0211864 | A1 | 9/2008 | Mealy et al. | |
| 2008/0212118 | A1 | 9/2008 | Mealy et al. | |
| 2008/0212120 | A1 * | 9/2008 | Mealy et al. | 358/1.12 |
| 2008/0213018 | A1 | 9/2008 | Mealy et al. | |
| 2008/0215286 | A1 | 9/2008 | Mealy et al. | |
| 2008/0262719 | A1 * | 10/2008 | Bledsoe et al. | 701/207 |

FOREIGN PATENT DOCUMENTS

| | | | |
|---|---|---|---|
| WO | WO 03/055689 | A1 | 7/2003 |
| WO | WO 03/076196 | A1 | 9/2003 |
| WO | WO 03/076197 | | 9/2003 |
| WO | WO 2004/056577 | A1 | 7/2004 |
| WO | WO 2004/088576 | | 10/2004 |
| WO | WO 2005/070684 | A1 | 8/2005 |

OTHER PUBLICATIONS

HP Ink Jet Printer Cartridge Anatomy, http://wandel.ca.hp45_anatomy/index.html, printed Apr. 19, 2007, pp. 1-8.

U.S. Appl. No. 11/952,849 entitled, "Handheld Tattoo Printer", filed Dec. 7, 2007, 43 pages.

U.S. Appl. No. 12/036,862, entitled, "Print Head Configuration for Hand-Held Printing", filed Feb. 25, 2008, 32 pages.

U.S. Appl. No. 12/039,491 entitled, "Cap Design for an Inkjet Print Head With Hand-Held Imaging Element Arrangement With Integrated Cleaning Mechanism", filed Feb. 28, 2008. 38 pages.

U.S. Appl. No. 12/041,466 entitled, "Ink Supply for a Hand-Held Ink Jet Printer", filed Mar. 3, 2008, 38 pages.

U.S. Appl. No. 12/074,123, entitled, "Managing Project Information with a Hand-Propelled Device", filed Feb. 28, 2008, 50 pages.

U.S. Appl. No. 12/132,405 entitled, Device and Method for Dispensing White Ink, filed Jun. 3, 2008, 37 pages.

U.S. Appl. No. 12/141,717, entitled, Hand-Held Printing Device and Method for Tuning Ink Jet Color for Printing on Colored Paper, filed Jun. 18, 2008, 38 pages.

International Search Report mailed Jul. 28, 2008, for International Application No. PCT/US2008/55636.

Written Opinion of the International Searching Authority mailed on Jul. 28, 2008, for International Application No. PCT/US2008/55636.

U.S. Appl. No. 11/955,209, filed Dec. 12, 2007, Bledsoe et al.

U.S. Appl. No. 11/955,228, filed Dec. 12, 2007, Bledsoe et al.

U.S. Appl. No. 11/955,240, filed Dec. 12, 2007, Bledsoe et al.

U.S. Appl. No. 11/955,258, filed Dec. 12, 2007, Simmons et al.

U.S. Appl. No. 11/955,027, filed Dec. 18, 2007, Simmons et al.

U.S. Appl. No. 11/972,462, filed Jan. 10, 2008, Simmons et al.

U.S. Appl. No. 12/013,313, filed Jan. 11, 2008, Bledsoe et al.

U.S. Appl. No. 12/016,833, filed Jan. 18, 2008, Simmons et al.

U.S. Appl. No. 12/073,029, filed Feb. 25, 2008, Bledsoe et al.

U.S. Appl. No. 12/083,660, filed Feb. 27, 2008, McKinley et al.

U.S. Appl. No. 12/062,472, filed Apr. 3, 2008, McKinley et al.

U.S. Appl. No. 12/188,056, filed Aug. 7, 2008, Mealy et al.

* cited by examiner

HAND-PROPELLED LABELING PRINTER

RELATED APPLICATION

This application claims the benefit of U.S. Provisional Application No. 60/892,727, filed on Mar. 2, 2007, which is incorporated herein by reference.

BACKGROUND

1. Technical Field

The present disclosure relates to the field of data collection, and more particularly to a device for printing a label on an object.

2. Related Art

Crime investigation and medical and scientific research are examples of activities that often include the collection and preservation of evidence, specimens, or samples ("preservation items"). Preservation items are commonly collected at crime scenes, excavation sites, forests, and other locations and immediately stored in storage objects such as evidence bags and containers. Stored preservation items are identified in the evidence bags and containers by a label and record system. The storage object may have a blank label imprinted thereon that is completed at the time a preservation item is deposited inside. The label is usually handwritten, and the label information is later read from the storage object and entered into a database as preservation item identification and information data. The data may include information such as a description of the preservation item, the data and time that it was collected, the location from which it was collected, an identification of the person who collected the item, and an identification number.

Errors may be introduced into the preservation item label and record system at several stages. For example, a label may be prepared with incorrect or incomplete information. Handwriting styles may also contribute to errors. Also, labels are constrained in size and therefore may not accommodate all of the necessary or desired information. Label information may be misread from the storage object when entered as data into a database system. Discrepancies between the label and record system and limited labeling capacity complicate investigative, scientific, and research processes, increase costs, and jeopardize the chain of custody of the preservation item. An improved approach to identifying preservation items is desirable.

BRIEF SUMMARY

The following embodiments relate to a mobile, handheld and hand-propelled labeling printer. The labeling printer receives image data from a source, such as a personal digital assistant or laptop or other processing device. The image data is based on label data to be printed on a storage object. The label data corresponds to preservation item identification and information data and is printed on the storage object by moving the labeling printer on a blank label as a print head dispenses ink in accord with the image data.

In a first embodiment, a labeling printer is a mobile, handheld, hand-propelled printer having a processor. The processor receives image data corresponding to label data and generates print data based on the image data. A label is applied to a storage object by moving the labeling printer on the storage object as a print mechanism dispenses ink in accord with print data received from the processor.

In a second embodiment, the labeling printer includes a position module to determine position data of the labeling printer as it is moved about while rendering an image on the storage object. The position data includes the location and the orientation of the labeling printer relative to an origin and an initial orientation. The processor receives image data corresponding to label data and generates print data based on the image data and the position data. The processor communicates the print data to a print mechanism for printing the label.

The label printed by the labeling printer may include a three-dimensional encoded bar code that is based on preservation item identification and information data, including a description of the preservation item, the data and time that the preservation item was collected, the location from which it was collected, an identification of the person who collected the item, an identification number, and other data. The label may also or alternatively print the preservation item identification and information data as text. The label may also include a picture of the preservation item.

The labeling printer may include a wireless interface to communicate with a host or other device, such as a personal digital assistant or a computer, for receiving image data corresponding to label data. The labeling printer may also or alternatively have a port for receiving a memory device having image data. The labeling printer may also or alternatively have a user interface, such as a keyboard, touch screen, or the like, to allow a user to create image data.

The position module may have a movement module to generate movement data in response to movement of the labeling printer. The movement data indicates the location and the orientation of the labeling printer relative to the origin and the initial orientation. The position module may also have two motion sensors to communicate motion signals to the movement module in response to movement of the labeling printer. In a preferred version, a position module processor receives the movement data and determines the position data. The position data includes location and orientation data indicative of a position of the labeling printer.

The labeling printer may have a housing having a length of approximately five inches, a width of approximately two inches, and a height of approximately one inch. The labeling printer may include a print mechanism having a plurality of nozzles arranged in rings around a sensor element such as a scan head.

Other systems, methods, and features of the invention will be, or will become, apparent to one with skill in the art upon examination of the following figures and detailed description. It is intended that all such additional systems, methods, features and advantages be included within this description, be within the scope of the invention, and be protected by the following claims.

The preferred embodiments will now be described with reference to the attached drawings.

DETAILED DESCRIPTION OF THE PRESENTLY PREFERRED EMBODIMENTS

The disclosure can be better understood with reference to the following drawings and description. The components in the figures are not necessarily to scale, emphasis instead being placed upon illustrating the principles of the invention. Moreover, in the figures, like referenced numerals designate corresponding parts or elements throughout the different views.

The embodiments below relate to a mobile, handheld and hand-propelled labeling printer for use in printing a label on a storage object. The labeling printer receives image data from a host or other device. The image data corresponds to label data from a preservation item database that includes preservation item identification data and collection information. The label data may include a description of the preservation item, the data and time that the preservation item was collected, the location from which it was collected, an identification of the person who collected the item, an identification number, and/or any other type of label data to be printed on a storage object. The preservation item database may reside on a personal digital assistant or laptop computer, as examples. The preservation item database may be populated with the label data at a collection site at the time the preservation item is collected. The labeling printer has a position module to maintain image alignment as the labeling printer is moved about a label section of the storage object to print the label. Because the image data is based on label data obtained from the preservation item database, complete consistency between the stored label data and the printed label is achieved.

Figure 1:
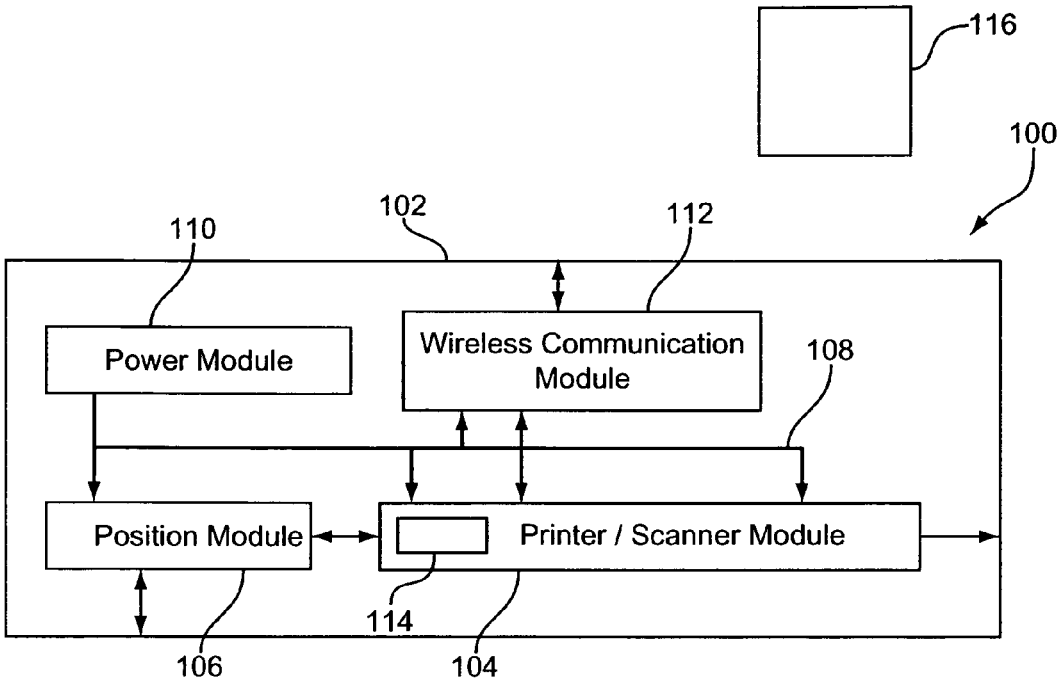
FIG. 1 is a diagram of a system that includes a version of a labeling printer for use in applying label data to a storage object in accord with an embodiment of the invention.

FIG. 1 is a diagram of a system 100 that includes a labeling printer 102 for use in applying label data to a storage object in accord with an embodiment of the invention. The labeling printer 102 is a mobile, handheld and hand-propelled printer or printer-scanner combination.

In a preferred embodiment, the labeling printer 102 has a printer/scanner module 104 having a module processor 114 for executing printing and/or scanning functions. The labeling printer 102 preferably includes a data bus 108, a power module 110, and a wireless communication module 112 to communicate with a host 116 or other device for receiving image data corresponding to label data. The labeling printer 102 may also or alternatively have a port (not shown) for establishing a physical connection to the host 116 or other device. It is to be understood that any data discussed hereinafter as communicated by way of the wireless communication module 112 may be communicated by way of a physical connection with the labeling printer 102. The labeling printer 102 may also include a slot or port for receiving a memory device such as a flash memory card or thumb drive, as examples. The labeling printer 102 may have a user interface, such as a keyboard, touch screen, or the like, to allow a user to create image data.

The labeling printer 102 is preferably handheld and hand-propelled, having dimensions suitable for single hand movement and control. In one version, the dimensions of the housing of the labeling printer 102 are approximately five inches in length, two inches in width, and one inch in height. It is to be understood that the labeling printer 102 may be any shape or size suitable for handheld, hand-propelled label data image rendering.

If the labeling printer 102 is a hand-propelled printer or printer-scanner, the wireless communication module 112 receives image data, such as a bitmap, from the host 116 and communicates the image data to the module processor 114. The image data corresponds to label data to be printed on a label section of a storage object. The label data may include a description of the preservation item, the data and time that the preservation item was collected, the location from which it was collected, an identification of the person who collected the item, an identification number, and/or any other type of label data to be printed on a storage object. The label data may be selected from data stored in a preservation item database maintained at the host 116 and communicated to the labeling printer 102 as image data. The host 116 may be a personal digital assistant, a lap-top computer, or other device that receives preservation item data. The preservation item data may be communicated to the host 116 at the time the preservation item is collected, or at some other time.

To print label data, the labeling printer 102 is placed on a storage object. The labeling printer 102 may be placed at a starting location in a designated, initial orientation to accurately align and position the label data on a storage object as it is printed.

As an operator moves the labeling printer 102 about the storage object, the label data is printed in accord with the image data. The labeling printer 102 may be moved about the storage object along different paths to render the entire label. The paths need not be linear or follow a predetermined pattern because the labeling printer 102 includes a position module 106 for determining the absolute position of the print head as it is moved in any direction to any location with respect to an origin or reference point. Thus, the labeling printer 102 accurately prints the entire label at the correct location as it is moved about the surface of the storage object, all the while continuously determining its position. The labeling printer 102 preferably provides an audio or visual signal to the user/operator when the label has been completely printed on the storage object.

As mentioned above, the labeling printer 102 includes a position module 106 for determining its location and orientation as it is moved about the storage object. The position module 106 provides location and orientation data to the module processor 114. The module processor 114 determines print data based on the image data and location and orientation data received from the position module 106. The module processor 114 communicates the print data to a print mechanism as the labeling printer 102 is moved about the surface of the storage object. The print mechanism renders the label data on the storage object based on the print data.

If the labeling printer 102 is a hand-propelled printer-scanner, label data may be scanned from a printed label and communicated as image data to the host 116. The label data may include a bar code, as an example, identifying a storage object and preservation item. To scan a storage object label, the labeling printer 102 is placed on and moved about the surface of the label as an imaging mechanism generates image signals. The module processor 114 receives the image signals from the imaging mechanism and determines image data based on the image signals and location and orientation data received from the position module 106. The host 116 may correlate the label data or bar code to a file in a database that includes information about the preservation item, collection procedure, and historical, research, progress, evidence, or any other information pertaining to the preservation item and/or its meaning, use, or purpose. The label data may be edited at the host 116, and a new, updated label may be printed for the preservation item. The edited image file may then be communicated back to the labeling printer 102 for printing on the storage object.

The host 116 may be a desktop or laptop computer, or other device that communicates (sends/receives) image data. The wireless communication module 112 and the host 116 may comprise a network such as a wireless local area network (WLAN), as an example.

Figure 2:
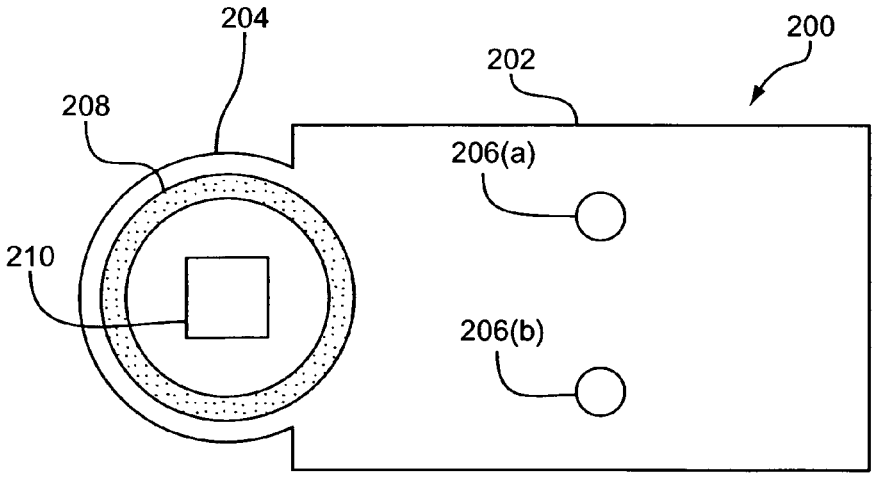
FIG. 2 is a bottom plan view of the labeling printer of FIG. 1.

FIG. 2 is an illustration of an embodiment of the printing and/or scanning side (underside) 202 of a handheld, hand-propelled labeling printer 200. The labeling printer 200 has two motion sensors 206(*a*) and 206(*b*) and an imaging mechanism 204. The imaging mechanism 204 includes a print head 208 and a scan head 210. The print head 208 is circular having a plurality of nozzles for dispensing ink. Because the print head is circular, ink may be deposited by the labeling printer 200 as it is moved in any direction. In one version, the print head 208 deposits ink along a one-third inch print path as the labeling printer 200 is moved. In other versions, the print path may be greater or less than one-third inch. As the labeling printer 200 is moved about a storage object, the motion sensors 206(*a*) and 206(*b*) generate motion signals for determining the absolute position of the print head 208 or scan head 210. This aspect of the labeling printer 200 is discussed in greater detail below with reference to the position module 106.

Figure 3A:
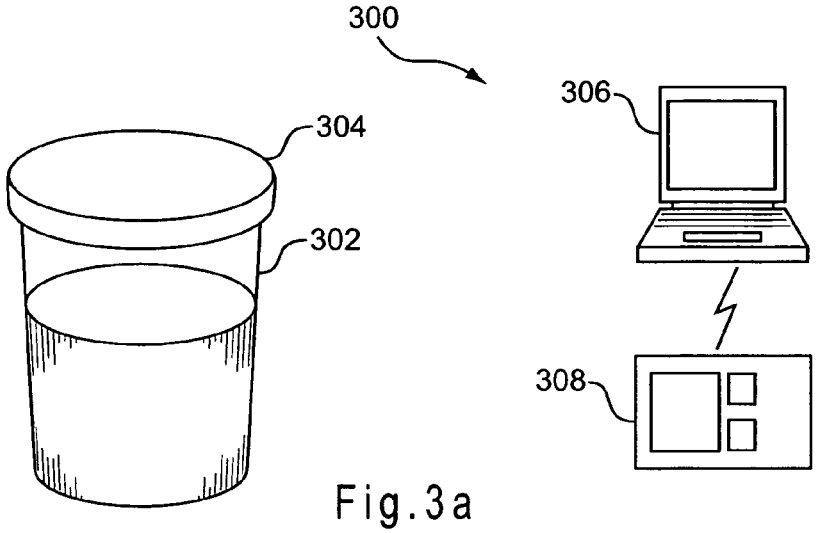
FIGS. 3(*a*)-3(*c*) illustrate an example of applying label data to a storage object using the labeling printer of FIG. 1.
Figure 3B:
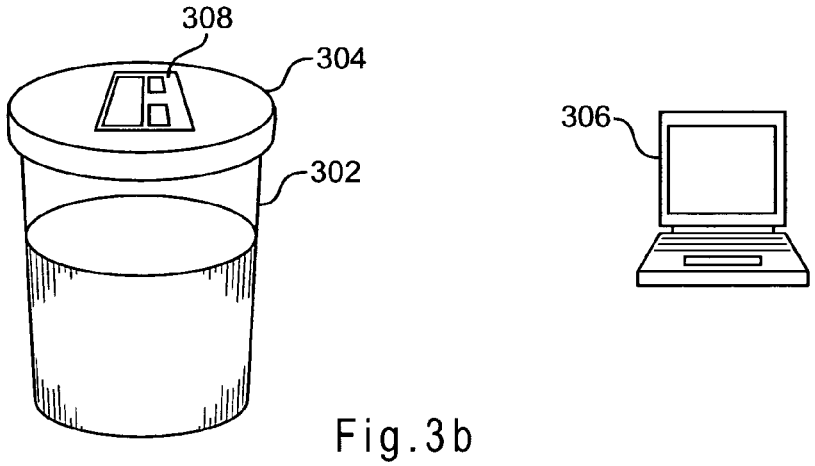
Figure 3C:
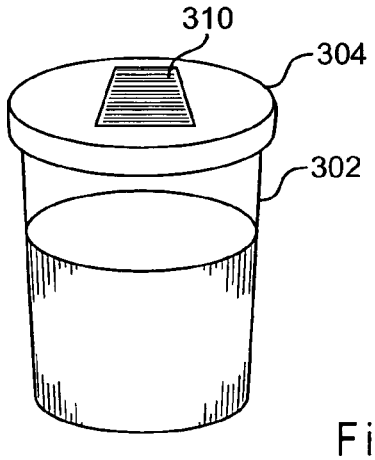

FIGS. 3(*a*)-3(*c*) illustrate an example of a system 300 for printing label data on the lid 304 of a storage object 302 using a handheld, hand-propelled labeling printer 308. In this example, the storage object 302 is an evidence container for preserving a liquid sample. A laptop computer 306 includes a memory device for storing preservation item identification data and collection information that may be entered by a user by way of an input device, such as a keyboard. Because the laptop computer 306 is portable, the preservation item identification data and collection information may be entered at the time of and location where the preservation item is collected and placed in the storage object 302. In alternate embodiments, a device other than a laptop computer 306 may be used to receive preservation item identification data and collection information, including a desktop computer, a personal digital assistant, or other device.

The preservation item identification data and collection information may include a description of the preservation item, the data and time that the preservation item was collected, the location from which it was collected, an identification of the person who collected the item, an identification number, and/or any other type of data pertaining to the preservation item. The laptop computer 306 may generate image data for printing a label having all or any subgroup of the preservation item identification data and collection information. Alternatively, the laptop computer 306 may execute instructions for generating bar code data representative of the preservation item. In a preferred version, the laptop computer 306 executes instructions to generate a three-dimensional encoded bar code having the preservation item identification data and collection information. The laptop computer 306 generates image data corresponding to a textual or barcode label.

FIG. 3(*b*) shows the labeling printer 308 placed on the lid 304 of the storage object 302. The labeling printer 308 is moved about the lid 304 as print data is communicated to a print head to print a barcode label 310, as shown in FIG. 3(*c*). As discussed above, the print data is based on image data and position data to accurately print the barcode label 310 on the lid 304. The labeling printer 308 may alternatively be placed on and moved about a side surface or bottom of the storage object 302. The labeling printer 308 may print on an adhesive label to be applied to the storage object 302 or lid 304, or may print directly on the storage object 302 or lid 304.

Figure 4:
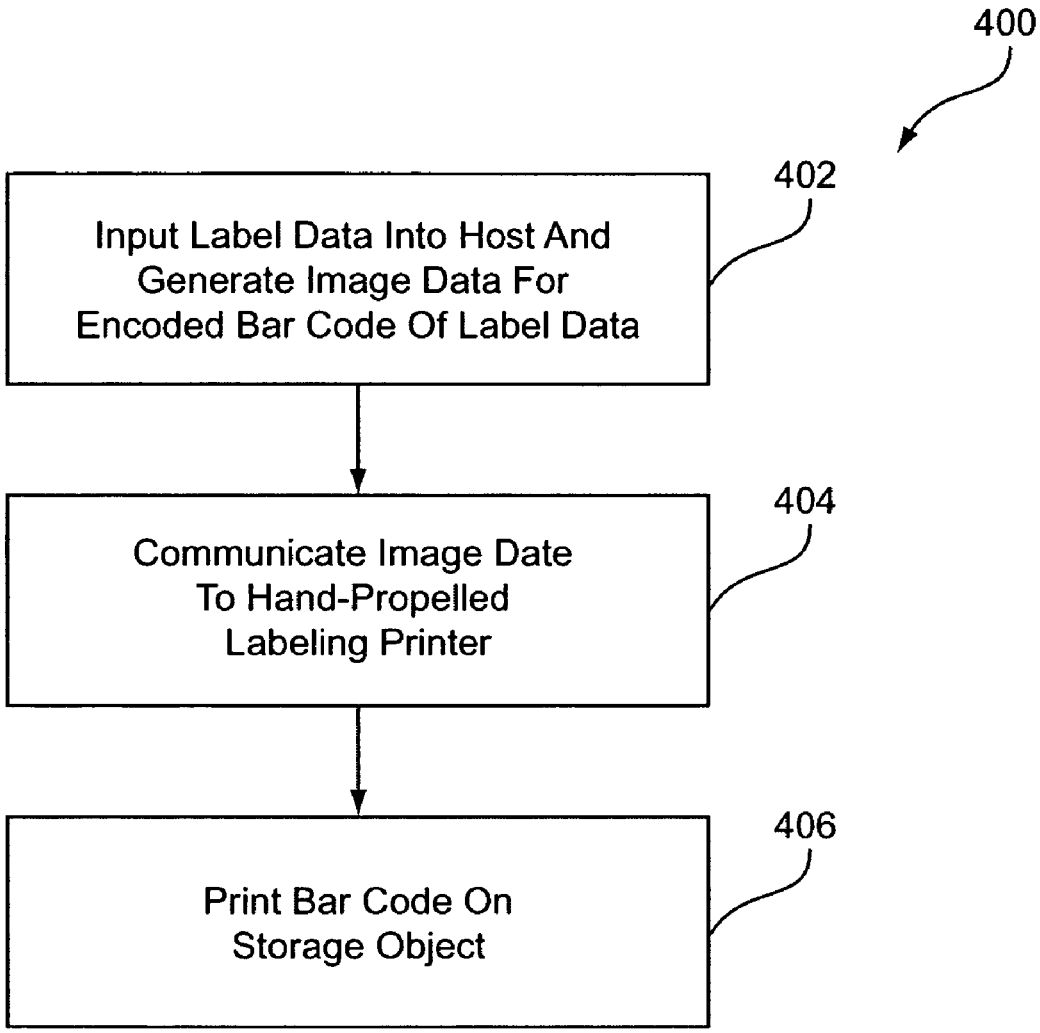
FIG. 4 shows acts for applying label data to a storage object in accord with an embodiment of the invention.

FIG. 4 shows acts (400) for printing label data in accord with an embodiment of the invention. Label data is communicated to a host device (by way of a keyboard or other interface) which generates image data for printing the label data, such as a bar code encoding the label data (Act 402). The image data is communicated to a hand-propelled labeling printer (Act 404). Alternatively, if the labeling printer has a user interface, a user may input label data directly into the labeling printer. The labeling printer may then generate the image data. The labeling printer is placed on a storage object, such as an evidence container, and moved about to print the bar code (Act 406).

Figure 5:
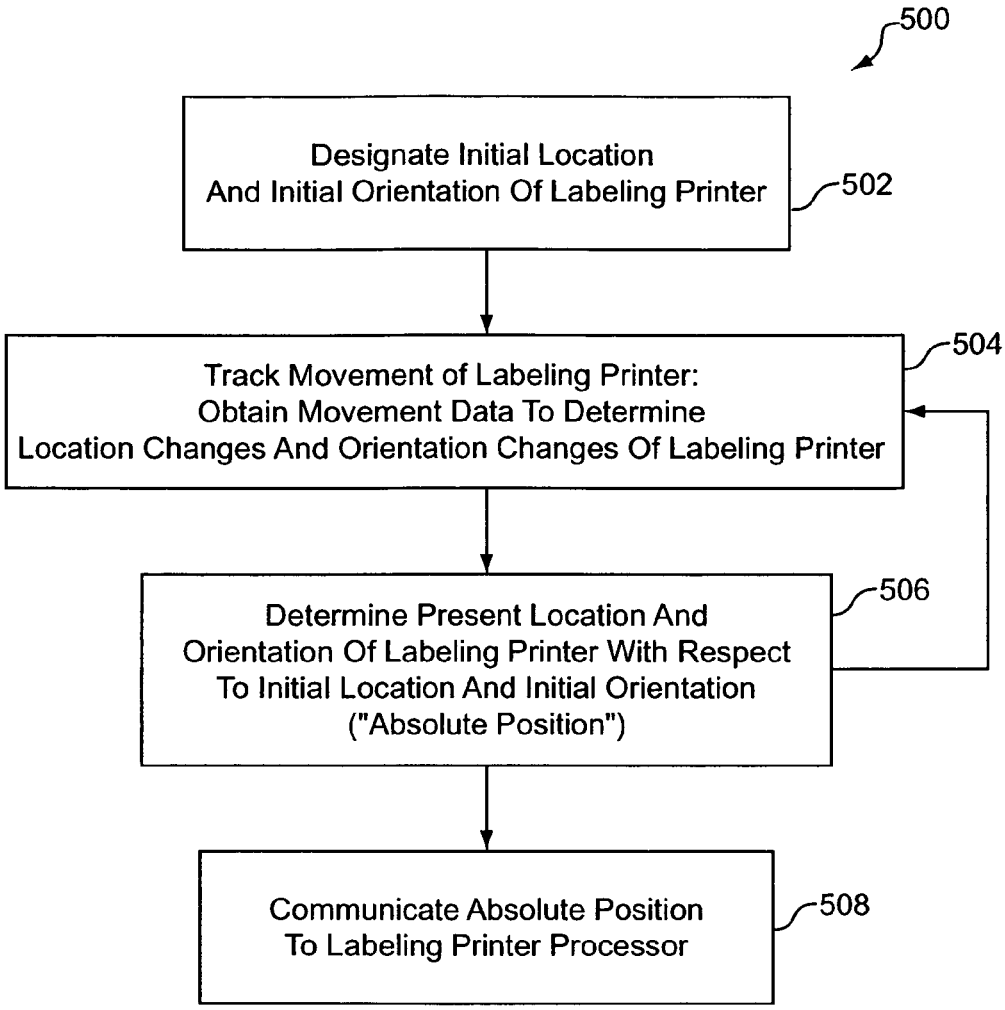
FIG. 5 shows acts for determining the location and orientation of a labeling printer with reference to an initial position as the printer is moved.

FIG. 5 shows acts 500 for determining the position of a labeling printer with reference to an initial position as the labeling printer is moved about on a storage object. The position of the labeling printer is defined by the labeling printer's location and orientation. The location of the labeling printer may be represented by any point defined within or on the labeling printer, such as a center-point or by an area of the labeling printer such as a print head or scan head. The orientation of the labeling printer is defined as an angle relative to an initial labeling printer orientation.

In one embodiment, the labeling printer is set at a position that is designated the initial position or "origin" of the labeling printer. The origin includes an initial location and initial orientation of the labeling printer on the storage object before the labeling printer is moved (Act 502). The act of designating an initial location and an initial orientation of the labeling printer may be referred to as "zeroing the origin." The initial location and initial orientation may be defined within any two or three dimensional coordinate system. The labeling printer may be set at a location determined for printing the label data.

As the labeling printer is moved, movement data is generated to track location changes and orientation changes of the labeling printer (Act 504). The movement data may be generated by any component, module, or any mechanism that generates data indicative of movement.

Figure 6:
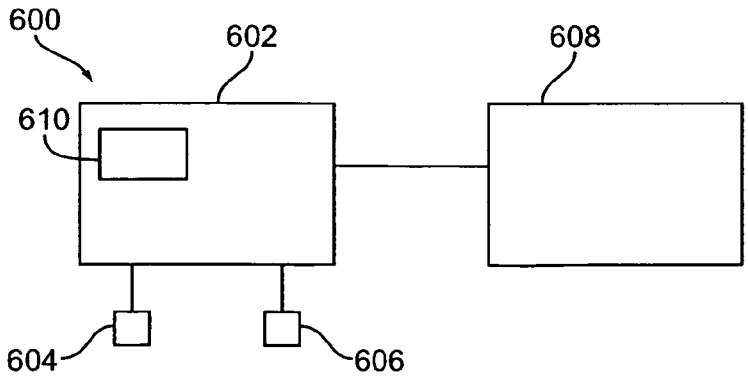
FIG. 6 is a block diagram of an embodiment of a position module for determining the location and orientation of a labeling printer with reference to an initial position.

FIG. 6 shows an embodiment of a position module 600 that generates movement data. The position module 600 includes a movement module 602 and a processor 608. The movement module 602 includes two motion sensors 604 and 606. The motion sensors 604, 606 may be optical motion sensors such as light-emitting diode (LED) and complementary medal-oxide semiconductor (CMOS) sensor pairs. Each CMOS sensor captures hundreds of images per second as is moves. The movement module 602 includes a movement module processor 610 to receive the images from the motion sensors 604, 606. The movement module processor 610 detects patterns in each image and compares the patterns of successive images to determine movement direction and distance of each CMOS sensor. In alternate versions, the motion sensors 604, 606 may be track-ball motion sensors, laser motion sensors, inertial motion sensors, or other type of motion sensors that generate movement signals. The movement module processor 610 may be any hardware, software, or firmware based processor.

Direction and distance data is generated for both motion sensors 604, 606 as the labeling printer moves. For example, as motion sensor 604 moves from point A to point B and motion sensor 606 moves from point M to point N, direction and distance data is generated by the movement module 602 for each sensor 604, 606. The location of motion sensor 604 with respect to point A and the location of motion sensor 606 with respect to point M is determined by the movement module 602 based on the direction and distance data generated for each respective sensor 604, 606. When motion sensor 604 next moves from point B to point C, the movement module 602 determines the location of motion sensor 204 with respect to point B. Likewise, when motion sensor 606 moves from point N to point O, the movement module 602 determines the location of motion sensor 606 with respect to point N. The movement module 602 generates movement data indicative of the movement of each motion sensor 604, 606 from point-to-point and communicates the movement data to the processor 608.

The processor 608 determines the position of the labeling printer with respect to the origin (the initial location and initial orientation of the labeling printer) by cumulating the movement data received from the movement module 602 (Act 506). The position of the labeling printer determined by the processor 608 includes both the location and orientation of the labeling printer with respect to the origin and may be referred to as the "absolute position" of the labeling printer.

The location of the labeling printer (or any point, line, or area of the labeling printer) is determined by cumulating the movement data, starting from the origin. The orientation of the labeling printer is defined as an angle between two lines: the first line is defined by the locations of the two motion sensors when the labeling printer is at the origin; the second line is defined by the locations of the two motion sensors when the labeling printer is at its respective location. As movement data continues to be received from the movement module 602 as the labeling printer moves, the processor 608 continues to update the absolute position of the labeling printer. The absolute position of the labeling printer may be communicated as location and orientation data to a labeling printer processor for use in printing label data on a storage object (Act 508).

Figure 7:
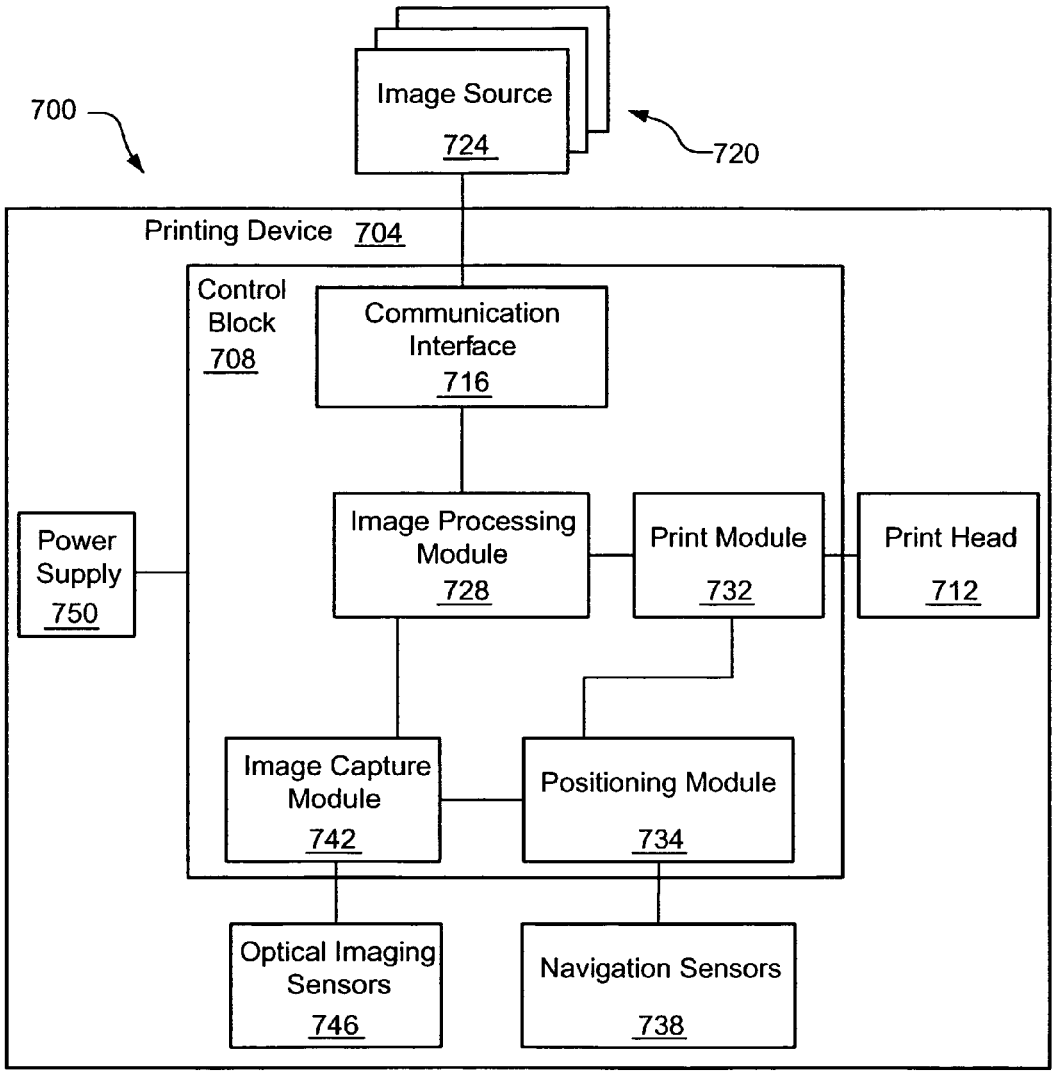
FIG. 7 is a schematic of a system that includes a version of a labeling printer for use in applying a label to a storage object in accord with an embodiment of the invention.

FIG. 7 is a schematic of a system 700 that includes a handheld printing and scanning device (hereinafter "printing device 704"), for use in printing label data on a storage object in accord with embodiments of the invention. The printing device 704 includes a control block 708 having components designed to facilitate precise and accurate positioning of a print head 712 throughout an entire printing and/or scanning operation. The use of positioning data provides for reliable image production, through printing, and image acquisition, through scanning, with a mobile and versatile handheld, hand-propelled printing device 704.

The control block 708 has a communication interface 716 configured to communicatively couple the control block 708 to other devices 720, which may include an image source 724. The image source 724 may be any type of device capable of transmitting data related to label data to be printed. The image source 724 may include a general purpose computing device, e.g., a desktop computing device, a laptop computing device, a mobile computing device, a personal digital assistant, a cellular phone, etc. or it may be a removable storage device, e.g., a flash memory data storage device, designed to store data such as image data. If the image source 724 is a removable storage device, e.g., a universal serial bus (USB) storage device, the communication interface may include a port, e.g., USB port, designed to receive the storage device.

The communication interface 716 may include a wireless transceiver to allow the communicative coupling with the image source 724 to take place over a wireless link. The image data may be wirelessly transmitted over the link through the modulation of electromagnetic waves with frequencies in the radio, infrared or microwave spectrums.

A wireless link may contribute to the mobility and versatility of the printing device 704. However, a printing device 704 may additionally/alternatively include a wired link communicatively coupling one or more of the other devices 720 to the communication interface 716.

In some versions of the printing device 704, the communication interface 716 communicates with the other devices 720 through one or more wired and/or wireless networks including, but not limited to, personal area networks, local area networks, wide area networks, metropolitan area networks, etc. The data transmission may be done in a manner compatible with any of a number of standards and/or specifications including, but not limited to, 802.11, 802.16, Bluetooth®, Global System for Mobile Communications (GSM), code-division multiple access (CDMA), Ethernet, etc.

The communication interface 716 transmits the received image data to an on-board image processing module 728. The image processing module 728 processes the received image data in a manner to facilitate an upcoming printing process. Image processing techniques may include dithering, decompression, half-toning, color plane separation, and/or image storage. In various embodiments some or all of these image processing operations may be performed by the image source 724, the printing device 704, or another device. The processed image may then be transmitted to a print module 732 where it is cached in anticipation of a print operation.

The print module 732 may also receive positioning information, indicative of a position of the print head 712 relative to a reference point, from a positioning module 734. The positioning module 734 may be communicatively coupled to one or more navigation sensors 738. The navigation sensors 738 may include a light source, e.g., LED, a laser, etc., and an optoelectronic sensor designed to take a series of pictures of a storage object surface adjacent to the printing device 704 as the printing device 104 is moved over the storage object. The positioning module 734 processes the pictures provided by the navigation sensors 738 to detect structural variations of the storage object surface. The movement of the structural variations in successive pictures indicates motion of the printing device 704 relative to the storage object. The precise positioning of the navigation sensors 738 can be determined by tracking the movement of the structural variations. The navigation sensors 738 may be maintained in a structurally rigid relationship with the print head 712, thereby allowing for the calculation of the precise location of the print head 712.

The navigation sensors 738 have operating characteristics for tracking movement of the printing device 704 within a desired degree of precision. In one example, the navigation sensors 738 process approximately 1500 frames per second, with each frame including a rectangular array of 18×18 pixels. Each pixel detects a six-bit grayscale value, e.g., capable of sensing 64 different levels of gray.

The print module 732 receives the positioning information and coordinates the location of the print head 712 to a portion of the processed image and a corresponding location on the storage object. The print module 732 controls the print head 712 to deposit a printing substance on the storage object to render the corresponding portion of the processed image.

The print head 712 may be an inkjet print head having a plurality of nozzles designed to emit liquid ink droplets. The ink, which may be contained in reservoirs/cartridges, may be black and/or any of a number of various colors. A common, full-color inkjet print head may have nozzles for cyan, magenta, yellow, and black ink.

The control block 708 may also include an image capture module 742. The image capture module 742 is communicatively coupled to one or more optical imaging sensors 746. The optical imaging sensors 746 may include a number of individual sensor elements. The optical imaging sensors 746 may be designed to capture a plurality of surface images, which may be individually referred to as component surface images. The image capture module 742 generates a composite image by stitching together the component surface images. The image capture module 742 receives positioning information from the positioning module 734 to facilitate the arrangement of the component surface images into the composite image.

In an embodiment in which the printing device 704 is capable of scanning full color images, the optical imaging sensors 746 have sensor elements capable of scanning different colors.

A composite image acquired by the printing device 704 may be transmitted to one or more of the other devices 720 by, e.g., e-mail, fax, file transfer protocols, etc. The composite image may be additionally/alternatively stored locally by the printing device 704 for subsequent review, transmittal, printing, etc.

In addition (or as an alternative) to composite image acquisition, the image capture module 742 may be utilized for calibrating the positioning module 734. In various embodiments, the component surface images (whether individually, some group, or collectively as the composite image) may be compared to the processed print image rendered by the image processing module 728 to detect accumulated positioning errors and/or to reorient the positioning module 734 in the event the positioning module 734 loses track of its reference point. This may occur, for example, if the printing device 704 is lifted off the storage object during a print operation.

The printing device 704 may include a power supply 750 coupled to the control block 708. The power supply 750 may be a mobile power supply, e.g., a battery, a rechargeable battery, a solar power source, etc. In other embodiments the power supply 750 may additionally/alternatively regulate power provided by another component (e.g., one of the other devices 720, a power cord coupled to an alternating current (AC) outlet, etc.).

Figure 8:
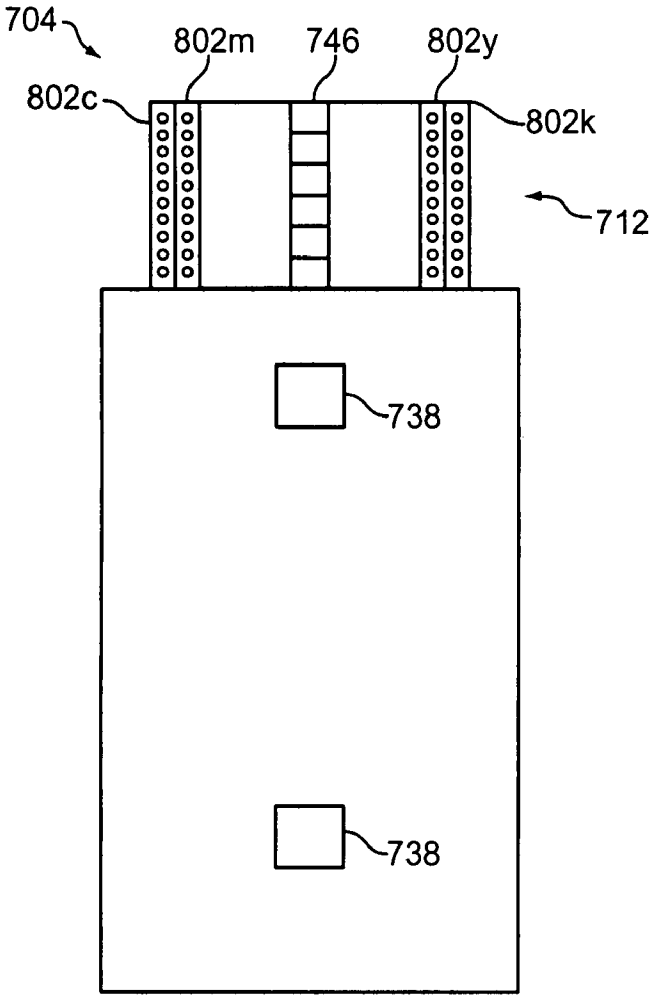
FIG. 8 is a bottom plan view of the labeling printer of FIG. 7.

FIG. 8 is a bottom plan view of the printing device 704 of FIG. 7. The printing device 704 includes two navigation sensors 738, a plurality of optical imaging sensors 746, and a print head 712.

As discussed above, the navigation sensors 738 communicate image data to the positioning module 734, which determines positioning information related to the optical imaging sensors 746 and/or the print head 712. As stated above, the proximal relationship of the optical imaging sensors 746 and/or print head 712 to the navigation sensors 738 may be fixed to facilitate the positioning of the optical imaging sensors 746 and/or print head 712 through information obtained by the navigation sensors 738.

The print head 712 may be an inkjet print head having a number of nozzle rows for different colored inks. In particular, and as shown in FIG. 8, the print head 712 may have a nozzle row 802*c* for cyan-colored ink, a nozzle row 802*m* for magenta-colored ink, a nozzle row 802*y* for yellow-colored ink, and nozzle row 802*k* for black-colored ink. The nozzle rows of the print head 712 may be arranged around the optical imaging sensors 746. This may allow for the optical imaging sensors 746 to capture information about the ink deposited on the storage object, which represents the processed image in various formative stages, for the predominant side-to-side motion of the printing device 704.

In various embodiments the placement of the nozzles of the print head 712 and the sensor elements of the optical imaging sensors 746 may be further configured to account for the unpredictable nature of movement of the hand-propelled printing device 704. For example, while the nozzles and sensor elements are arranged in linear arrays in the printing device 704 other embodiments may arrange the nozzles and/or sensor elements in other patterns. In some embodiments the nozzles may be arranged completely around the sensor elements so that whichever way the printing device 704 is moved the optical imaging sensors 746 will capture component images reflecting deposited ink. In some embodiments, the nozzles may be arranged in rings around the sensor elements (e.g., concentric circles, nested rectangular patterns, etc.).

While the nozzle rows 802*c*, 802*m*, 802*y*, and 802*k* shown in FIG. 8 are arranged in rows according to their color, other embodiments may intermix the different colored nozzles in a manner that may increase the chances that an adequate amount of appropriate colored ink is deposited on the storage object through the natural course of movement of the printing device 700 on the storage object.

In the embodiment depicted by FIG. 8, the linear dimension of the optical imaging sensors 746 may be similar to the linear dimension of the nozzle rows of the print head 712. The linear dimensions may refer to the dimensions along the major axis of the particular component, e.g., the vertical axis of the optical imaging sensors 746 as shown in FIG. 8. Having similar linear dimensions may provide that roughly the same amount of passes over a storage object are required for a complete scan and print operation. Furthermore, having similar dimensions may also facilitate the positioning calibration as a component surface image captured by the optical imaging sensors 746 may correspond to deposits from an entire nozzle row of the print head 712.

Figure 9:
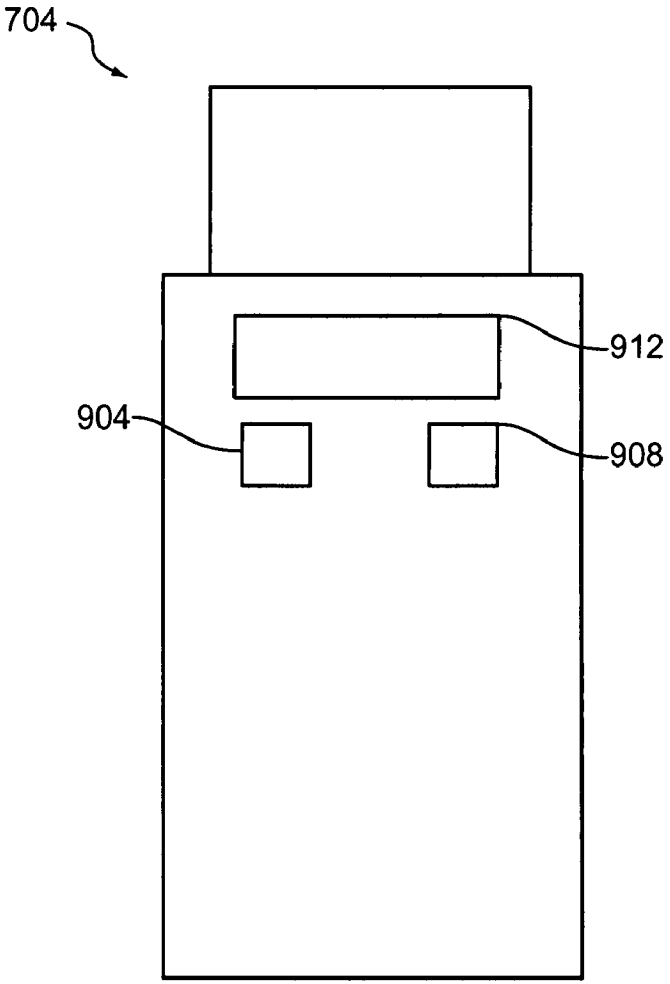
FIG. 9 is a top plan view of the labeling printer of FIG. 7.

FIG. 9 is a top plan view of the printing device 704 of FIG. 7. The printing device 704 may have a variety of user input/outputs to provide the functionality enabled through use of the printing device 704. Some examples of input/outputs that may be used to provide some of the basic functions of the printing device 704 include, but are not limited to, a print control input 904 to initiate/resume a print operation, a scan control input 308 to initiate/resume a scan operation, and a display 912.

The display 912, which may be a passive display, an interactive display, etc., may provide the user with a variety of information. The information may relate to the current operating status of the printing device 704 (e.g., printing, ready to print, scanning, ready to scan, receiving print image, transmitting print image, transmitting scan image, etc.), power of the battery, errors (e.g., scanning/positioning/printing error, etc.), instructions (e.g., "position device over a printed portion of the image for reorientation," etc.). If the display 912 is an interactive display it may provide a control interface in addition to, or as an alternative from, the control inputs 904 and 908.

Figure 10:
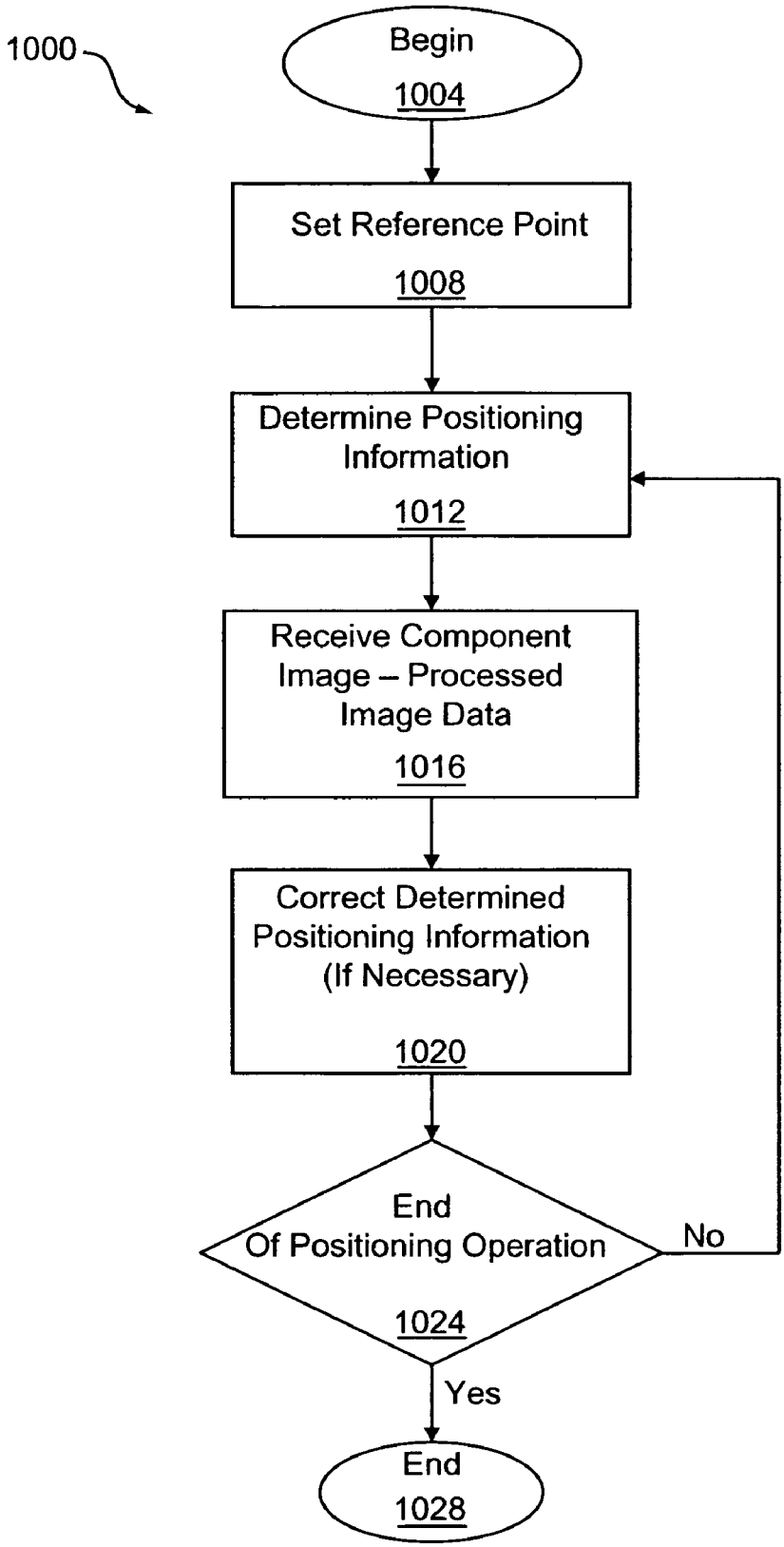
FIG. 10 shows acts of a positioning operation of a labeling printer in accord with various embodiments of the present invention.

FIG. 10 shows Acts 1000 of a positioning operation of the printing device 704 in accordance with various embodiments of the present invention. A positioning operation may begin with an initiation of a scanning or a printing operation, e.g., by activation of the print control input 904 or the scan control input 908 (Act 1004). The positioning module 734 within the printing device 700 may set a reference point (Act 1008). The reference point may be set when the printing device 700 is placed on a storage object at the beginning of a print job. This may be ensured by the user being instructed to activate the control input once the printing device 704 is in place and/or by the proper placement of the printing device 704 being treated as a condition precedent to instituting the positioning operation. In some embodiments the proper placement of the printing device 704 may be automatically determined through the navigation sensors 738, the optical imaging sensors 746, and/or some other sensors (e.g., a proximity sensor).

Once the reference point is set, the positioning module 734 determines positioning information, e.g., translational and/or rotational changes from the reference point, using the navigation sensors 738 (Act 1012). The translational changes may be determined by tracking incremental changes of the positions of the navigation sensors along a two-dimensional coordinate system, e.g., $\Delta x$ and $\Delta y$. Rotational changes may be determined by tracking incremental changes in the angle of the printing device with respect to either the x-axis or the y-axis. These transitional and/or rotational changes may be determined by the positioning module 734 comparing consecutive navigational images taken by the navigation sensors 738 to detect these movements.

The positioning module 734 may also receive component surface images from the optical imaging sensors 746 and processed image data from the image processing module (Act 1016). If the positioning information is accurate, a particular component surface image from a given location should match a corresponding portion of the processed image. If the given location is one in which the print head 712 has deposited something less than the target print volume for the location, the corresponding portion of the processed image may be adjusted to account for the actual deposited volume for comparison to the component surface image. In the event that the print head 712 has yet to deposit any material in the given location, the positioning information may not be verified through this method. However, the verification of the positioning information may be done frequently enough given the constant movement of the printing device 704 and the physical arrangement of the nozzle rows of the print head 712 in relation to the optical imaging sensors 746.

If the particular component surface image from the given location does not match the corresponding portion of the processed image, the positioning module 734 may correct the determined positioning information (Act 1020). Given adequate information, e.g., sufficient material deposited in the location captured by the component surface image, the positioning module 734 may set the positioning information to the offset of the portion of the processed image that matches the component surface image. In most cases this may be an identified pattern in close proximity to the location identified by the incorrect positioning information. In the event that the pattern captured by the component surface image does not identify a pattern unique to the region surrounding the incorrect positioning information, multiple component surface images may be combined in an attempt to identify a unique pattern. Alternatively, correction may be postponed until a component surface image is captured that does identify a pattern unique to the surrounding region.

In some embodiments, correction of the determined positioning information may be done periodically in order to avoid overburdening the computational resources of the positioning module 734.

Following correction, the positioning module 734 determines whether the positioning operation is complete (Act 1024). If it is determined that the positioning operation is not yet complete, the operation loops back (to Act 1012). If it is determined that it is the end of the positioning operation, the operation ends (Act 1028). The end of the positioning operation may be tied to the end of the printing/scanning operation, which will be discussed with reference to FIGS. 11 and 12, respectively.

Figure 11:
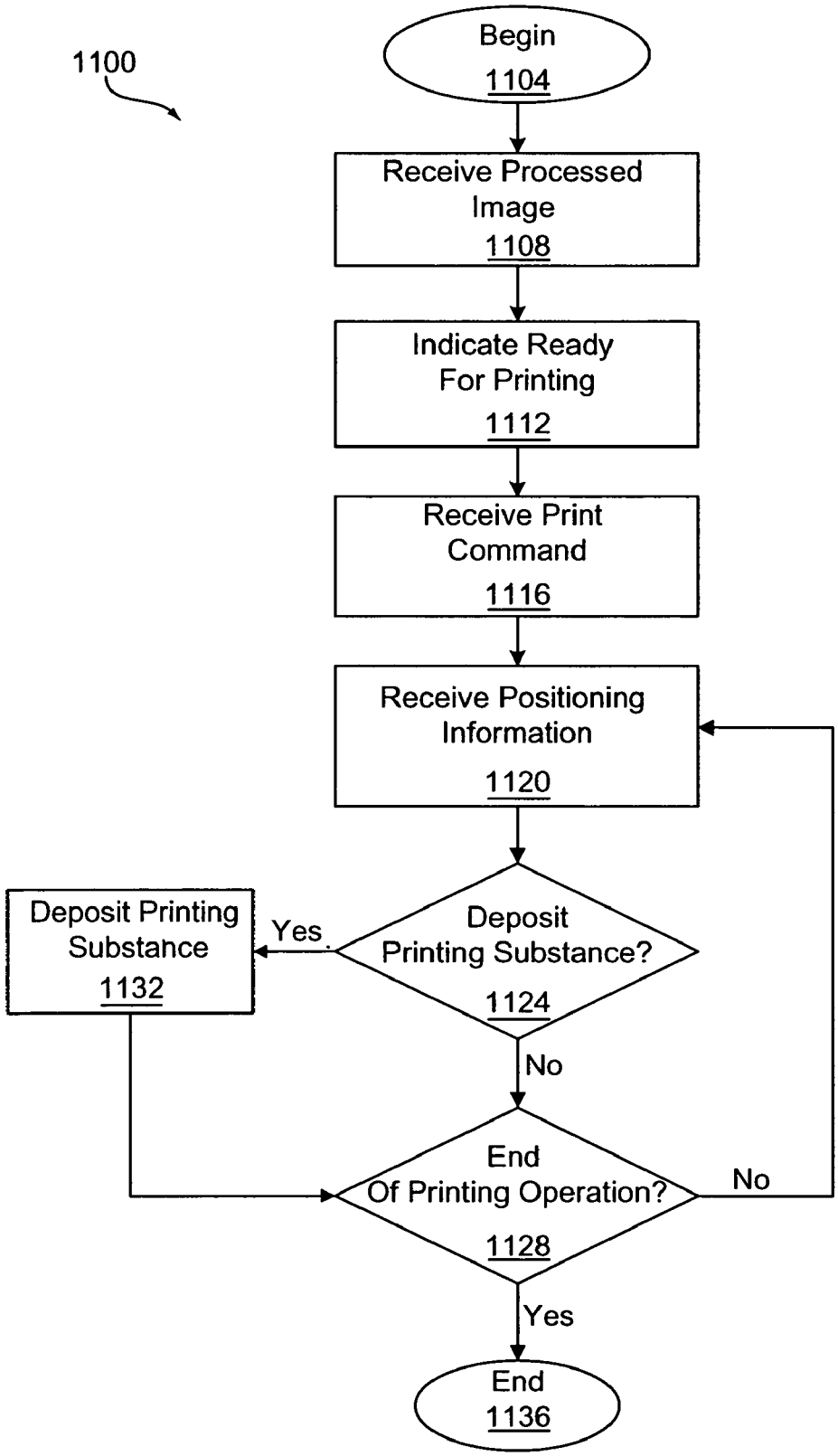
FIG. 11 shows acts of a printing operation implemented by the labeling printer of FIG. 7.

FIG. 11 shows Acts 1100 of a printing operation of the printing device 704 in accord with various embodiments of the present invention. The printing operation begins (Act 1104) and the print module 732 receives a processed image from the image processing module 728 (Act 1108). Upon receipt of the processed image, the display 912 indicates that the printing device 700 is ready for printing (Act 1112).

The print module 732 receives a print command generated from a user activating the print control input 904 (Act 1116). The print module 732 receives positioning information from the positioning module 734 (Act 1120). The print module 732 determines whether to deposit printing substance at the given position (Act 1124). The determination as to whether to deposit printing substance may be a function of the total drop volume for a given location and the amount of volume that has been previously deposited.

If it is determined that no additional printing substance is to be deposited, the operation may advance to determine whether the end of the print operation has been reached (Act 1128). If it is determined that additional printing substance is to be deposited, the print module 732 causes an appropriate amount of printing substance to be deposited by generating and transmitting control signals to the print head 712 that cause the nozzles to drop the printing substance (Act 1132).

The determination of whether the end of the printing operation has been reached may be a function of the printed volume versus the total print volume. In some embodiments the end of the printing operation may be reached even if the printed volume is less than the total print volume. For example, an embodiment may consider the end of the printing operation to occur when the printed volume is ninety-five percent of the total print volume. However, it may be that the distribution of the remaining volume is also considered in the end of print analysis. For example, if the five percent remaining volume is distributed over a relatively small area, the printing operation may not be considered to be completed.

In some embodiments, an end of print job may be established by a user manually cancelling the operation.

If it is determined that the printing operation has been completed, the printing operation ends (Act 1136).

If it is determined that the printing operation has not been completed, the printing operation loops back (to Act 1120).

Figure 12:
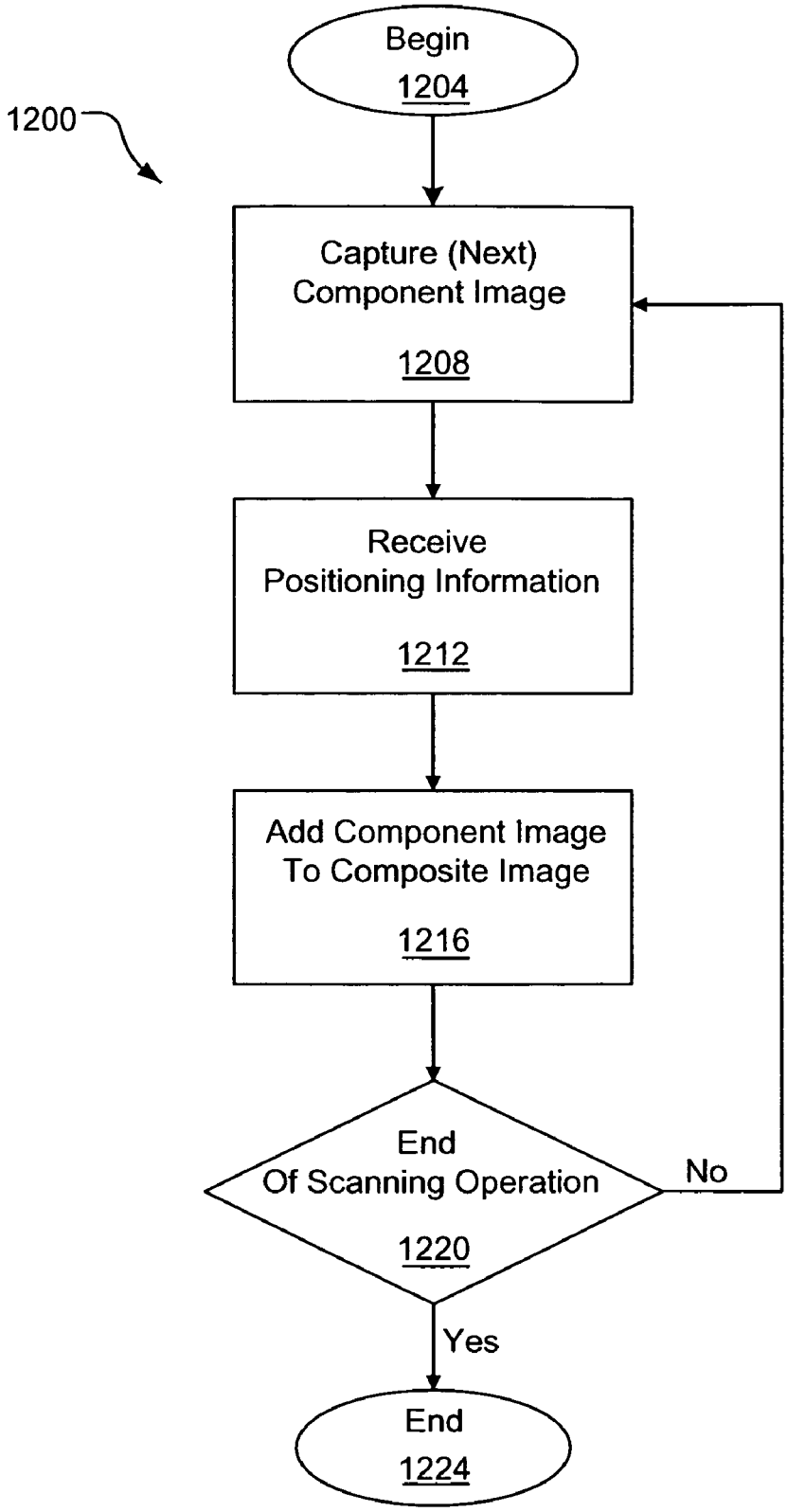
FIG. 12 shows acts of a scanning operation implemented by the labeling printer of FIG. 7.

FIG. 12 shows Acts 1200 of a scanning operation of the printing device 704. The scanning operation begins with the receipt of a scan command generated from a user activating the scan control input 908 (Act 1204).

The image capture module 742 controls the optical imaging sensors 746 to capture one or more component images (Act 1208). In some embodiments, the scan operation will only commence when the printing device 704 is placed on a print medium such as a label printed on a storage object. This may be ensured by manners similar to those discussed above with respect to the printing operation, e.g., by instructing the user to initiate scanning operation only when the printing device 704 is in place and/or automatically determining that the printing device 704 is in place.

The image capture module may receive positioning information from the positioning module (Act 1212) and add the component images to the composite image (Act 1216). The image capture module determines whether the scanning operation is complete (Act 1220).

The end of the scanning operation may be determined through a user manually cancelling the operation and/or through an automatic determination. In some embodiments, an automatic determination of the end of print job may occur when all interior locations of a predefined image border have been scanned. The predefined image border may be determined by a user providing the dimensions of the image to be scanned or by tracing the border with the printing device 704 early in the scanning sequence.

If it is determined that the scanning operation has been completed, the scanning operation ends (Act 1224).

If it is determined that the scanning operation has not been completed, the scanning operation loops back (to Act 1208).

Figure 13:
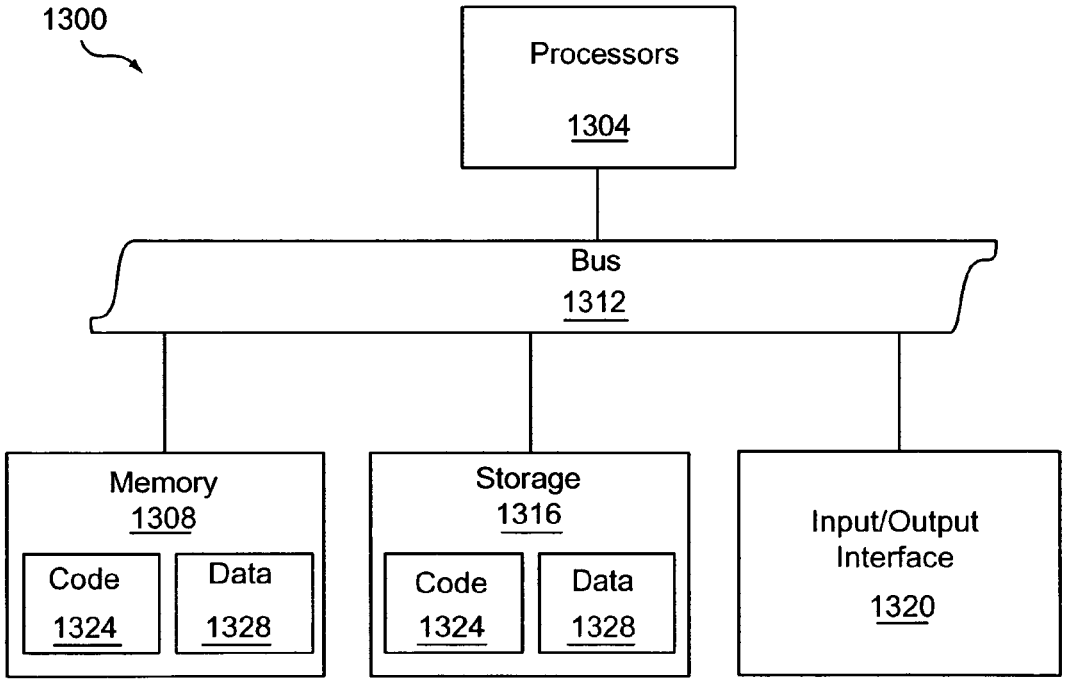
FIG. 13 illustrates a version of a computing device that implements the control block of the labeling printer of FIG. 7.

FIG. 13 illustrates a version of a computing device 1300 implementing a control block, e.g., control block 708. Computing device 1300 includes one or more processors 1304, memory 1308, and bus 1312, coupled to each other as shown. Additionally, computing device 1300 includes storage 1316, and one or more input/output interfaces 1320 coupled to each other, and the earlier described elements as shown. The components of the computing device 1300 may be designed to provide the printing, scanning, and/or positioning functions of a control block of a printing device as described herein.

Memory 1308 and storage 1316 may include, in particular, temporal and persistent copies of code 1324 and data 1328, respectively. The code 1324 may include instructions that when accessed by the processors 1304 result in the computing device 1300 performing operations as described in conjunction with various modules of the control block in accordance with embodiments of this invention. The processing data 1328 may include data to be acted upon by the instructions of the code 1324. In particular, the accessing of the code 1324 and data 1328 by the processors 1304 may facilitate printing, scanning, and/or positioning operations as described herein.

The processors 1304 may include one or more single-core processors, multiple-core processors, controllers, application-specific integrated circuits (ASICs), etc.

The memory 1308 may include random access memory (RAM), dynamic RAM (DRAM), static RAM (SRAM), synchronous DRAM (SDRAM), dual-data rate RAM (DDRRAM), etc.

The storage 1316 may include integrated and/or peripheral storage devices, such as, but not limited to, disks and associated drives (e.g., magnetic, optical), USB storage devices and associated ports, flash memory, read-only memory (ROM), non-volatile semiconductor devices, etc. Storage 1316 may be a storage resource physically part of the computing device 1300 or it may be accessible by, but not necessarily a part of, the computing device 1300. For example, the storage 1316 may be accessed by the computing device 1300 over a network.

The I/O interfaces 1320 may include interfaces designed to communicate with peripheral hardware, e.g., print head 712, navigation sensors 738, optical imaging sensors 746, etc., and/or remote devices, e.g., other devices 720.

In various embodiments, computing device 1300 may have more or less elements and/or different architectures.

All of the discussion above, regardless of the particular implementation being described, is exemplary in nature, rather than limiting. Although specific components of the devices disclosed herein are described, methods, systems, and articles of manufacture consistent with the devices (e.g., labeling printer 102 and printing device 704) may include additional or different components. For example, components of the devices 102 and 704, host 116, and image source 720 may be implemented by one or more of: control logic, hardware, a microprocessor, microcontroller, application specific integrated circuit (ASIC), discrete logic, or a combination of circuits and/or logic. Further, although selected aspects, features, or components of the implementations are depicted as hardware or software, all or part of the systems and methods consistent with the devices 102 and 704, host 116, and image source 720 may be stored on, distributed across, or read from machine-readable media, for example, secondary storage devices such as hard disks, floppy disks, and CD-ROMs; a signal received from a network; or other forms of ROM or RAM either currently known or later developed. Any act or combination of acts may be stored as instructions in computer readable storage medium. Memories may be DRAM, SRAM, Flash or any other type of memory. Programs may be parts of a single program, separate programs, or distributed across several memories and processors.

The processing capability of the system may be distributed among multiple system components, such as among multiple processors and memories, optionally including multiple distributed processing systems. Parameters, databases, and other data structures may be separately stored and managed, may be incorporated into a single memory or database, may be logically and physically organized in many different ways, and may implemented in many ways, including data structures such as linked lists, hash tables, or implicit storage mechanisms. Programs and rule sets may be parts of a single program or rule set, separate programs or rule sets, or distributed across several memories and processors.

It is intended that the foregoing detailed description be understood as an illustration of selected forms that the invention can take and not as a definition of the invention. It is only the following claims, including all equivalents, that are intended to define the scope of this invention.

What is claimed is:

1. A labeling printer, comprising:

at least one optical scanning sensor element configured to capture images of a surface indicative of movement of the labeling printer;

a print mechanism comprising a plurality of nozzles arranged in a ring in a plane and facing the surface, wherein the at least one optical scanning sensor element is inside the ring;

a position module to determine position data of the labeling printer in response to the movement of the labeling printer, wherein the position data includes a location and an orientation of the labeling printer relative to an origin and an initial orientation; and a processor to receive image data corresponding to label data and to communicate print data to the print mechanism, wherein the print data is based on the image data and the position data.

2. The labeling printer of claim 1 wherein the label data is selected from a group consisting of: a description of a preservation item, a date and a time that the preservation item was collected, a location from which the preservation item was collected, an identification of a person who collected the preservation item, and an identification number.

3. The labeling printer of claim 1 wherein the image data corresponds to a bar code.

4. The labeling printer of claim 1 further comprising a wireless interface to communicate with a host for receiving the image data.

5. The labeling printer of claim 1 further comprising a housing having a length of approximately five inches, a width of approximately two inches, and a height of approximately one inch.

6. The labeling printer of claim 1 wherein the image data corresponds to a picture of a preservation item.

7. The labeling printer of claim 1 wherein the position module comprises:

a movement module to generate movement data in response to movement of the labeling printer, the movement data indicative of the location and the orientation of the labeling printer relative to the origin and the initial orientation;

first and second motion sensors to communicate motion signals to the movement module in response to the movement of the labeling printer; and a position module processor to determine the position data based on the movement data.

8. The labeling printer of claim 1, wherein at least one of the location and the orientation of the labeling printer in the position data is three dimensional.

9. A labeling printer, comprising:

means for capturing images of a surface indicative of movement of the labeling printer;

means for determining position data of the labeling printer in response to the movement of the labeling printer;

means for receiving image data corresponding to label data; and means for communicating print data to a print mechanism comprising a plurality of nozzles arranged in a ring in a plane and facing the surface, the print mechanism comprising a sensor element inside the ring of nozzles, wherein the print data is based on the image data and the position data.

10. The labeling printer of claim 9 further comprising means for communicating with a host for receiving the image data.

11. The labeling printer of claim 9 wherein the image data corresponds to a bar code for identifying a preservation item.

12. The labeling printer of claim 9 further comprising:

means for generating movement data in response to movement of the labeling printer; and means for determining the position data based on the movement data.

13. A method comprising:

capturing images of a surface indicative of movement of a labeling printer;

determining position data of the labeling printer in response to the movement of the labeling printer, wherein the position data includes a location and an orientation of the labeling printer relative to an origin and an initial orientation;

receiving image data corresponding to label data; and communicating print data to a print mechanism comprising a plurality of nozzles arranged in a ring in a plane and facing the surface, the print mechanism comprising a sensor element inside the ring, wherein the print data is based on the image data and the position data.

14. The method of claim 13 wherein the label data is one of a description of a preservation item, a data and a time that the preservation item was collected, a location from which the preservation item was collected, an identification of a person who collected the preservation item, and an identification number.

15. The method of claim 13 wherein the image data corresponds to a bar code.

16. The method of claim 13 wherein the image data corresponds to a picture of a preservation item.

17. The method of claim 13 further comprising:

generating movement data in response to movement of the labeling printer, the movement data indicative of the location and the orientation of the labeling printer relative to the origin and the initial orientation;

communicating motion signals to a movement module in response to movement of the labeling printer; and determining the position data based on the movement data.

18. A computer readable storage medium having processor executable instructions to:

capture images, using a sensor element, of a surface indicative of movement of a labeling printer;

determine position data of the labeling printer in response to the movement of the labeling printer, wherein the position data includes a location and an orientation of the labeling printer relative to an origin and an initial orientation;

receive image data corresponding to label data; and communicate print data to a print mechanism comprising a plurality of nozzles arranged in a ring in a plane and facing the surface, wherein a sensor element is inside the ring, wherein the print data is based on the image data and the position data.

19. The computer readable storage medium of claim 18 wherein the label data is one of a description of a preservation item, a date and a time that the preservation item was collected, a location from which the preservation item was collected, an identification of a person who collected the preservation item, and an identification number.

20. The computer readable storage medium of claim 18 wherein the image data corresponds to a bar code or a picture of a preservation item.

21. The computer readable storage medium of claim 18 having processor executable instructions to communicate with a host for receiving the image data.

22. The computer readable storage medium of claim 18 having processor executable instructions to:

generate movement data in response to movement of the labeling printer, the movement data indicative of the location and the orientation of the labeling printer relative to the origin and the initial orientation;

communicate motion signals to a movement module in response to movement of the labeling printer; and determine the position data based on the movement data.

* * * * *